US007243467B2

(12) United States Patent
Peccoraro

(10) Patent No.: US 7,243,467 B2
(45) Date of Patent: Jul. 17, 2007

(54) APPARATUS FOR SECURING AN OPENING WITH A REMOVABLE COVER

(76) Inventor: Lawrence Peccoraro, 46 Big Buck Trail, Ormond Beach, FL (US) 32174

( * ) Notice: Subject to any disclaimer, the term of this patent is extended or adjusted under 35 U.S.C. 154(b) by 0 days.

(21) Appl. No.: 11/396,742

(22) Filed: Apr. 3, 2006

(65) Prior Publication Data

US 2007/0094949 A1 May 3, 2007

Related U.S. Application Data

(60) Provisional application No. 60/723,227, filed on Oct. 3, 2005.

(51) Int. Cl.
*E06B 3/26* (2006.01)

(52) U.S. Cl. ..... 52/202; 52/741.3; 52/739.1; 52/127.2; 52/643

(58) Field of Classification Search ..... 52/741.3, 52/202, 127.2, 203; 188/267; 267/275–78; 109/59, 60
See application file for complete search history.

(56) References Cited

U.S. PATENT DOCUMENTS 2,794,217 A * 6/1957 Croft ..... 248/200.1
3,682,462 A * 8/1972 Papousek ..... 267/34
4,741,505 A * 5/1988 Anderson ..... 248/357
5,224,298 A * 7/1993 Horst ..... 49/506
6,330,768 B1 * 12/2001 Rodrigues ..... 52/202
6,450,057 B1 * 9/2002 Winkler et al. ..... 74/473.37
6,505,803 B1 * 1/2003 Hernandez ..... 248/354.5
7,024,743 B2 * 4/2006 Heaton ..... 29/271
2005/0056760 A1 * 3/2005 Carlson ..... 248/354.3

* cited by examiner

*Primary Examiner*—Jeanette Chapman
*Assistant Examiner*—Dan Kenny
(74) *Attorney, Agent, or Firm*—Robert M. Schwartz; David W. Barman; Alfred K. Dassler

(57) ABSTRACT

A securing apparatus for securing a cover in a window opening, the securing apparatus engages fastening locations on opposite sides of a window opening. The securing apparatus includes a tube having a first end and a second end. A connector is disposed on the tube at the first end. A precut tube is attached to the connector to engage one of the fastening locations. An end cap is rigidly fixed to the tube at the second end. A threaded shaft is disposed in the tube and projects from the second end through the end cap. A mounting tube is rigidly attached to the threaded shaft, the mounting tube engages another of the fastening locations. An adjusting nut is disposed on the threaded shaft between the end cap and the mounting tube, the adjusting nut adjusts a position of the mounting tube with respect to the tube.

8 Claims, 5 Drawing Sheets

APPARATUS FOR SECURING AN OPENING WITH A REMOVABLE COVER

CROSS-REFERENCE TO RELATED APPLICATIONS

This application claims the benefit of U.S. Provisional Application Ser. No. 60/723,227, filed on Oct. 3, 2005, entitled METHOD AND APPARATUS FOR SECURING AN OPENING WITH A REMOVABLE COVER; the prior application is herewith incorporated by reference in its entirety.

BACKGROUND OF THE INVENTION

1. Field of the Invention

The present invention pertains to an apparatus that is used for securing a cover to a window. More specifically, to an apparatus for securing a piece of plywood or corrugated sheet metal in a window opening.

2. Description of the Related Art

The present invention is an apparatus for holding a cover on a window opening. In the event of a hurricane or tropical storm, windows are typically secured with plywood sheets or corrugated metal sheets that are screwed onto a wall or fastened with a nut to studs that project from the wall.

The disadvantages of a securing a window opening as described above are that it is very time consuming to apply the many screws or nuts that are required to hold the cover or panel. This can lead to difficulties in securing all the windows of a domicile prior to the arrival of a storm. It also affords the possibility for an installer to be injured drilling the many holes required to secure a panel.

SUMMARY OF THE INVENTION

It is accordingly an object of the invention to provide an apparatus for securing an opening with a cover which overcomes the above-mentioned disadvantages of the heretofore-known devices of this general type and which provides an apparatus for securing an opening with a cover that is easy to install and easy to use.

With the foregoing and other objects in view there is provided, a securing apparatus for securing a cover in a window opening, the securing apparatus engages fastening locations on opposite sides of a window opening. The securing apparatus includes a tube having a first end and a second end. A connector is disposed on the tube at the first end. A precut tube is attached to the connector for engaging one of the fastening locations. An end cap is rigidly fixed to the tube at the second end. A threaded shaft is disposed in the tube and projects from the second end through the end cap. A mounting tube is rigidly attached to the threaded shaft, the mounting tube engages the other of the fastening locations.

An adjusting nut is disposed on the threaded shaft between the end cap and the mounting tube, the adjusting nut adjusts a position of the mounting tube with respect to the tube.

In accordance with another feature of the invention, the securing apparatus further includes a further end cap rigidly fixed at the first end. A compression spring is disposed in the tube between the first end cap and the threaded shaft. A further compression spring is disposed on the threaded shaft and abuts the end cap, the further spring opposes the spring for biasing the adjusting nut against the end cap.

In accordance with a further feature of the invention, the threaded shaft has a head, the spring and the further spring abut opposites sides of the head.

In accordance with yet a further feature of the invention, a first bearing plate is disposed between the compression spring and the head. A second bearing plate disposed on the threaded shaft between the head and the further compression spring.

In accordance with an added feature of the invention, a sleeve is disposed on the threaded shaft between the threaded shaft and the spring. The sleeve abuts the second bearing plate.

In accordance with an additional feature of the invention, the mounting tube has a shoulder for affixing the mounting tube to the threaded shaft.

In accordance with a further mode of the invention, the shoulder is sandwiched between two attachment nuts disposed on the threaded shaft.

In accordance with another mode of the invention, there is also provided, a securing apparatus for securing a cover in a window opening, the securing apparatus engages fastening locations on opposite sides of a window opening. The securing apparatus includes a tube having a first end and a second end. A connector is disposed on the tube at the first end. A precut tube is attached to the connector for engaging one of the fastening locations. A threaded shaft is disposed in the tube and projects from the second end. The threaded shaft is adjustably mounted with respect to the tube. A mounting tube is rigidly attached to the threaded shaft. The mounting tube engages the other of the fastening locations.

Other features which are considered as characteristic for the invention are set forth in the appended claims.

Although the invention is illustrated and described herein as embodied as a an apparatus for securing an opening, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
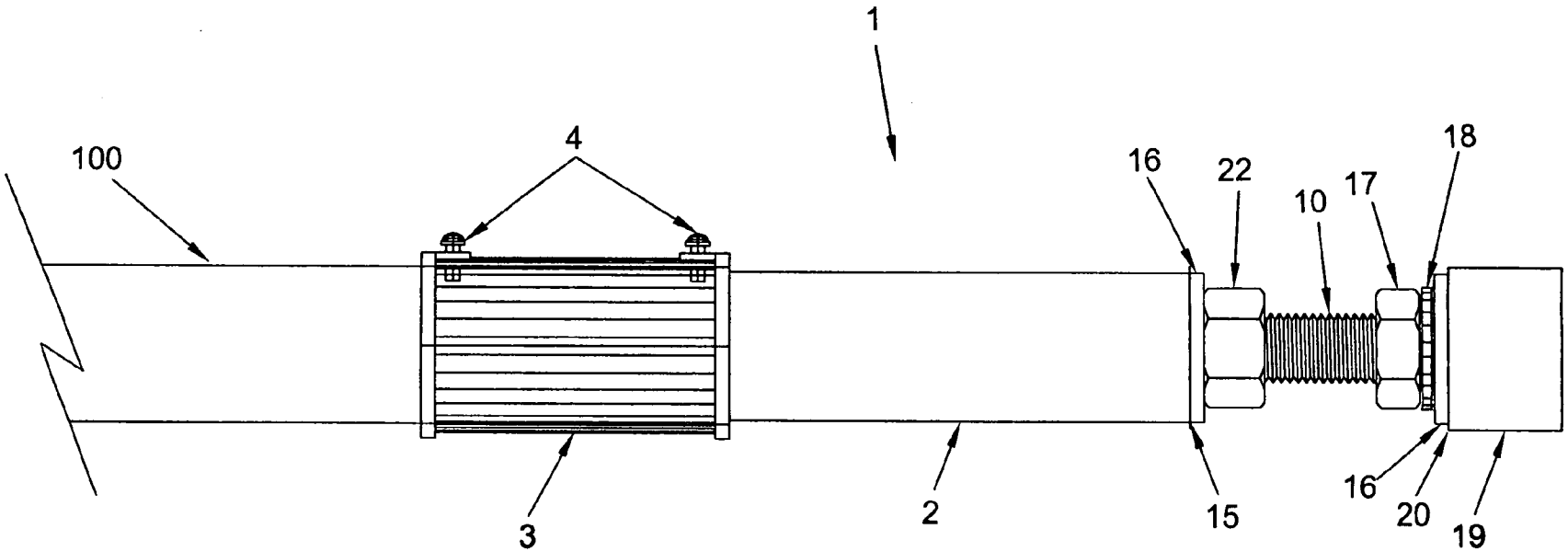
FIG. 1 is a side elevational view of the apparatus according to the invention.
Figure 2:
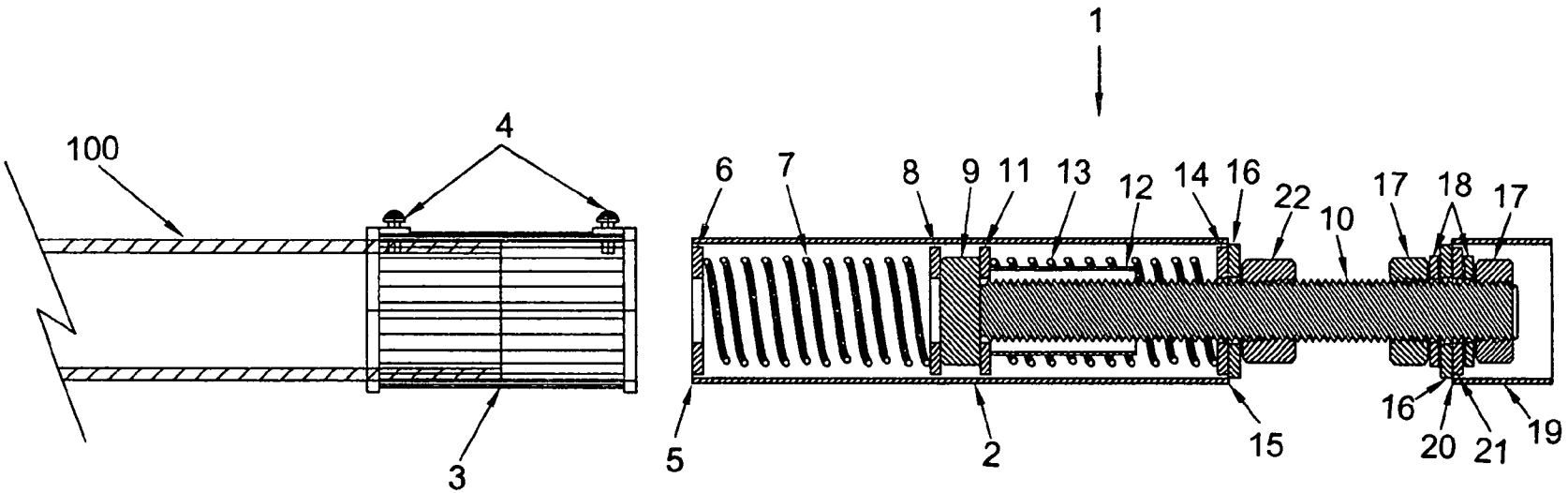
FIG. 2 is a sectional view of the apparatus according to the invention.

Referring now to the figures of the drawing in detail and first, particularly, to FIGS. 1 and 2 thereof, a securing apparatus 1, which spans an outside frame of a window opening 200 is shown. The securing apparatus has a tube 2 with a first end 5 and a connecting collar 3 for attaching the apparatus 1 to a precut piece of tube 100 at the first end 5.

The collar 3 can be fixed to the tube 2 by screws 4 or any other suitable fastening device.

Figure 3:
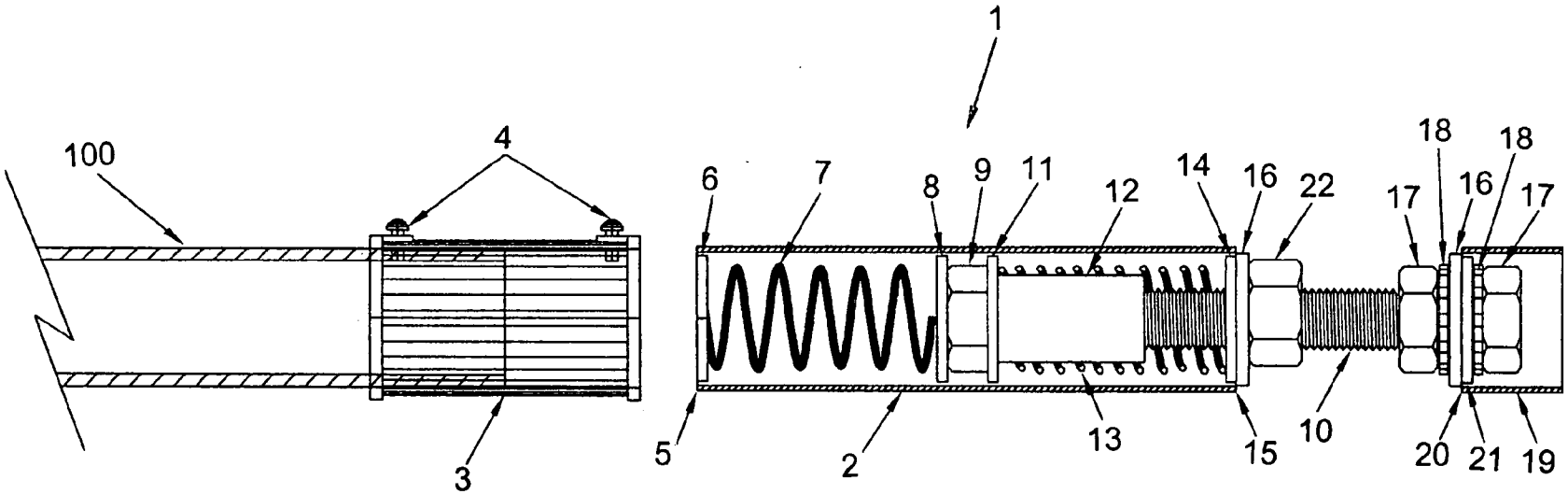
FIG. 3 is a partial sectional view of the apparatus according to the invention.
Figure 4:
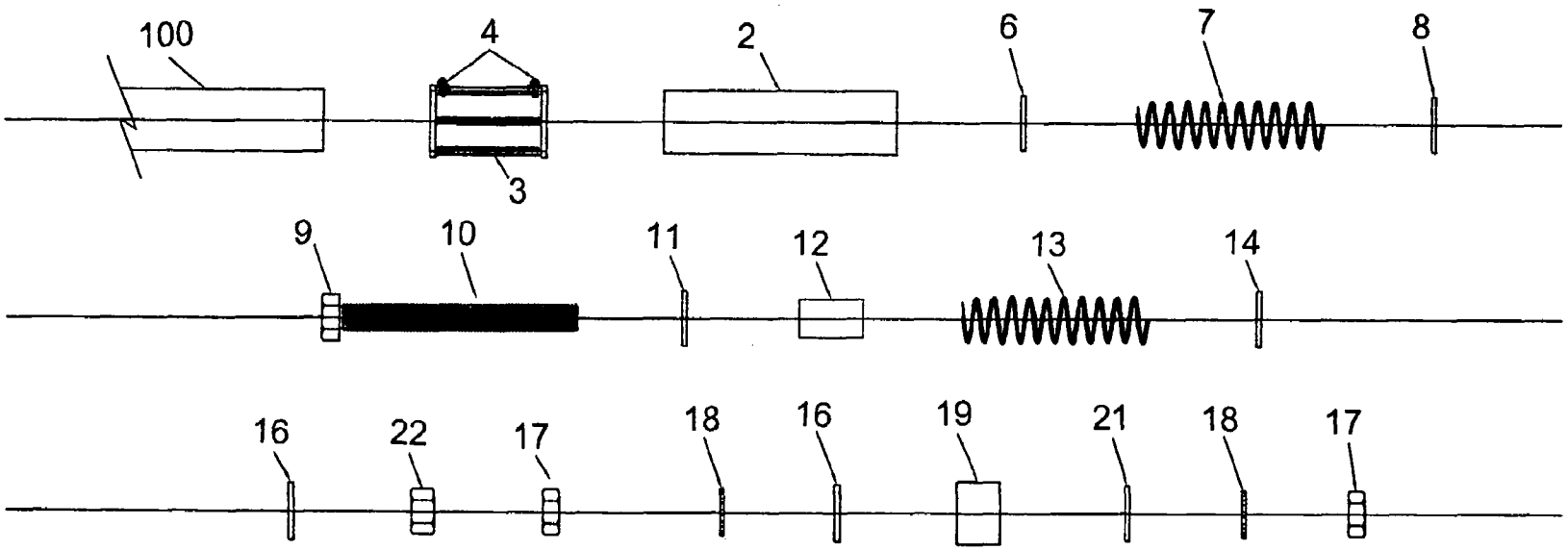
FIG. 4 is an exploded side view of the apparatus according to the invention.
Figure 5:
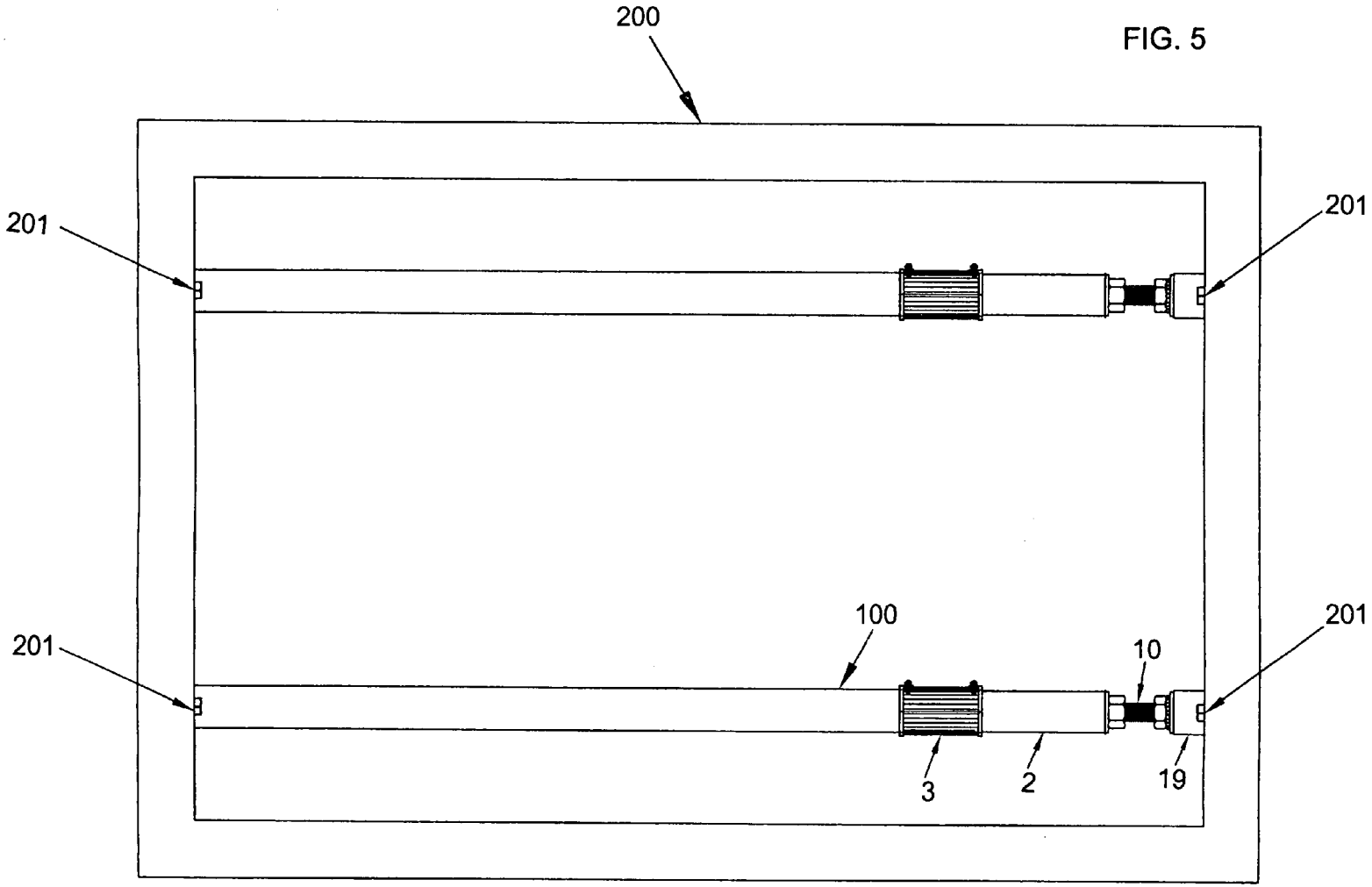
FIG. 5 is a diagrammatic side view of the apparatus according to the invention installed in a window opening.

FIGS. 2, 3, and 4 show the components of the device inside the tube 2. Beginning at the first end 5 a first end cap 6 is rigidly fixed in the tube 2. A first spring 7 is disposed in the tube 2 and abuts the first end cap 6. A bearing plate 8 is disposed at the opposite end of the first spring 7 inside the tube 2. A threaded shaft 10 having a head 9 disposed thereon abuts the bearing plate 8 inside of the tube 2. A second bearing plate 11 is disposed on the threaded shaft 10 and abuts the head 9. A second spring 13 is disposed on the threaded shaft 10 and inside the tube 2. The bearing plates 8 and 11 help to prevent the springs 7 and 13 from binding inside the tube 2. A sleeve 12 is also disposed on the threaded shaft 10 in between the threaded shaft 10 and the second spring 13. A second end cap 14 is rigidly fixed to the tube 2 at a second end 15 of the tube 2.

The threaded shaft 10 projects from the tube 2 through the second end cap 14. A washer 16 is disposed on the threaded shaft 10 and abuts the tube 2. An adjusting nut 22 acts on the washer 16 to set the length of the apparatus 1 for securing the apparatus 1 at fastening locations 201 that are disposed on opposite sides of the window opening 200. A nut 17 is disposed on the threaded shaft 10 and is followed by a lock washer 18. A mounting tube 19 with a shoulder 20 is disposed on the threaded shaft 10 and abuts the lock washer 18. The mounting tube 19 is held on the shaft 10 against the lock washer by a further lock washer 18 and a further nut 17 which act on the shoulder 20.

As is shown in FIG. 3, one possibility is for the shoulder 20 to include a washer 16 which abuts the mounting tube 19 and a third end cap 21 that is rigidly fixed inside the mounting tube 19. However, it is noted that many different possibilities exist for attaching the mounting tube 19 to the shaft 10, for example the mounting tube may be welded directly to the shaft 10.

The use of the above-described quick securing apparatus 1 is as follows. Fastening locations 201 such as masonry screws or holes formed in the window frame, etc. are disposed opposite one another on opposite faces of a window opening 200. A piece of tube 100 is precut to the necessary length and is affixed to the outer 2 using the connecting collar 3. A cover is placed in the window opening 200 against the window. The tube 100 is placed over the head of one of the screws 201 and the mounting tube 19 is placed over the head of the remaining screw 201. The length-adjusting nut 22 is tightened to increase the length of the apparatus 1 until it is secure in the window opening

I claim:

1. A securing apparatus for securing a cover in a window opening, the securing apparatus for engaging fastening locations on opposite sides of a window opening, the securing apparatus comprising:

a tube having a first end and a second end;

a connector disposed on said tube at said first end;

a precut tube attached to said connector for engaging one of the fastening locations;

an end cap rigidly fixed to said tube at said second end;

a threaded shaft disposed in said tube and projecting from said second end through said end cap;

a mounting tube rigidly attached to said threaded shaft, said mounting tube engaging the other of the fastening locations; and an adjusting nut disposed on said threaded shaft between said end cap and said mounting tube, said adjusting nut adjusting a position of said mounting tube with respect to the tube.

2. The securing apparatus according to claim 1, further comprising:

a further end cap rigidly fixed at said first end;

a compression spring disposed in said tube between said further end cap and said threaded shaft; and a further compression spring disposed on said threaded shaft and abutting said end cap, said further spring opposing said spring for biasing said adjusting nut against said end cap.

3. The securing apparatus according to claim 2, wherein said threaded shaft has a head, said spring and said further spring abutting opposites sides of said head.

4. The securing apparatus according to claim 3, further comprising a first bearing plate disposed between said compression spring and said head and a second bearing plate disposed on said threaded shaft between said head and said further compression spring.

5. The securing apparatus according to claim 1, wherein said mounting tube has a shoulder for affixing said mounting tube to said threaded shaft.

6. The securing apparatus according to claim 5, wherein said shoulder is sandwiched between two attachment nuts disposed on said threaded shaft.

7. The securing apparatus according to claim 4, further comprising a sleeve disposed on said threaded shaft between said threaded shaft and said spring, said sleeve abutting said second bearing plate.

8. A securing apparatus for securing a cover in a window opening, the securing apparatus for engaging fastening locations on opposite sides of a window opening, the securing apparatus comprising:

a tube having a first end and a second end;

a connector disposed on said tube at said first end;

a precut tube attached to said connector for engaging one of the fastening locations;

a threaded shaft disposed in said tube and projecting from said second end, said threaded shaft being adjustable with respect to said tube; and a mounting tube rigidly attached to said threaded shaft, said mounting tube engaging the other of the fastening locations.

* * * * *

UNITED STATES PATENT AND TRADEMARK OFFICE

CERTIFICATE OF CORRECTION

PATENT NO. : 7,243,467 B2
APPLICATION NO. : 11/396742
DATED : July 17, 2007
INVENTOR(S) : Lawrence Pecoraro It is certified that error appears in the above-identified patent and that said Letters Patent is hereby corrected as shown below:

Title Page Item (12) and (76):

Delete "Peccoraro" and Insert --Pecoraro--.

Signed and Sealed this

Eighteenth Day of September, 2007

JON W. DUDAS
*Director of the United States Patent and Trademark Office*